US008550266B2

(12) United States Patent
Settlemier et al.

(10) Patent No.: US 8,550,266 B2
(45) Date of Patent: Oct. 8, 2013

(54) RING DERRICK WITH STATIONARY COUNTERWEIGHT

(75) Inventors: Weston J. Settlemier, San Leandro, CA (US); Vaughn L. Hersey, San Leandro, CA (US)

(73) Assignee: Bigge Crane & Rigging Co., San Leandro, CA (US)

( * ) Notice: Subject to any disclaimer, the term of this patent is extended or adjusted under 35 U.S.C. 154(b) by 581 days.

(21) Appl. No.: 12/761,545

(22) Filed: Apr. 16, 2010

(65) Prior Publication Data

US 2010/0264105 A1 Oct. 21, 2010

Related U.S. Application Data

(60) Provisional application No. 61/170,441, filed on Apr. 17, 2009.

(51) Int. Cl.
*B66C 23/72* (2006.01)
*B66C 23/84* (2006.01)

(52) U.S. Cl.
USPC ..... 212/195; 212/253

(58) Field of Classification Search
USPC ..... 212/175–179, 195–198, 301–304, 212/312, 253
See application file for complete search history.

(56) References Cited

U.S. PATENT DOCUMENTS

| | | | | |
|---|---|---|---|---|
| 3,379,464 | A * | 4/1968 | Bradshaw | 403/39 |
| 3,836,010 | A | 9/1974 | Lampson | |
| 3,955,684 | A | 5/1976 | Novotny | |
| 4,134,707 | A | 1/1979 | Ewers | |
| 4,170,309 | A * | 10/1979 | Lampson | 212/198 |
| 4,243,148 | A * | 1/1981 | Lampson | 212/196 |
| 4,316,548 | A | 2/1982 | Helm et al. | |
| 4,318,423 | A * | 3/1982 | DeGraaf | 137/615 |
| 4,483,448 | A | 11/1984 | Wittman et al. | |
| 4,601,402 | A | 7/1986 | Helm et al. | |
| 4,614,275 | A | 9/1986 | Zenno | |
| 4,673,093 | A | 6/1987 | Van Ketel | |
| 5,522,515 | A | 6/1996 | Pech et al. | |
| 5,901,864 | A | 5/1999 | Morrow | |
| 5,941,401 | A | 8/1999 | Petzold et al. | |
| 6,146,471 | A * | 11/2000 | Hartl et al. | 148/206 |
| 6,279,764 | B1 | 8/2001 | Stoof | |
| 6,305,560 | B1 * | 10/2001 | Meyer | 212/301 |
| 6,508,372 | B1 | 1/2003 | Lamphen | |
| 6,679,394 | B2 | 1/2004 | Schuffert et al. | |
| 6,926,611 | B2 * | 8/2005 | Rivin | 464/70 |

(Continued)

FOREIGN PATENT DOCUMENTS

| | | | |
|---|---|---|---|
| DE | 3024286 | A1 * | 1/1982 |
| WO | 96/05391 | | 2/1996 |

*Primary Examiner* — William E Dondero
*Assistant Examiner* — Nathaniel Adams
(74) *Attorney, Agent, or Firm* — Shoemaker and Mattare

(57) ABSTRACT

A ring derrick includes a carriage which moves on a fixed circular track around a stationary counterweight. A tension and compression column assembled from transportable tubular segments is affixed to the counterweight by a universal swivel joint. The back mast of the derrick is secured at its upper end to the tension column, while the main boom of the derrick extends radially away from the tension column. The main boom and back mast are hinged directly together at the carriage by massive hinge pins which pass through spherical bearings mounted on the carriage. The carriage's suspension distributes the load from the boom and mast to an array of trucks and has an automatic stabilizing system that compensates for uneven track.

12 Claims, 18 Drawing Sheets

(56) References Cited

U.S. PATENT DOCUMENTS

2004/0164040 A1 8/2004 Delago
2005/0211653 A1* 9/2005 Franzen ..... 212/270
2008/0203045 A1 8/2008 Pech et al.
2008/0251484 A1 10/2008 Commandeur et al.

* cited by examiner

RING DERRICK WITH STATIONARY COUNTERWEIGHT

This application claims benefit of provisional U.S. patent application 61/170,441, filed Apr. 17, 2009.

BACKGROUND OF THE INVENTION

This invention relates to a ring derrick having a stationary counterweight.

Cranes and derricks lift heavy loads at varying radii from the base of the lifting boom. The value of the load times radius—load moment—is an important measure of lifting capacity. The world's largest crawler cranes have maximum load moments of about 32,000 metric tonne-meters (Manitowoc 31000), 44,000 tonne-meters (Terex Demag CC8800 Twin), 50,000 tonne-meter range (new Liebherr XXL not yet released), and 80,000 tonne-meters (Lampson LTL2600). These maximum load moments typically occur at minimum operating radius with the heaviest lifted load.

It would be desirable to achieve substantially greater load moment capacity, at much greater operating radii.

Typical mobile crawler cranes may produce ground bearing pressures of 20,000 psi. Such pressures normally require a pile-supported foundation system. It would be better to substantially reduce bearing pressures and thus avoid the need for a pile supported foundation.

Maximum operating wind speeds for cranes identified above are in the 18 mph range. Low wind tolerance can cause considerable down time, which leads to schedule problems for a major construction project. Substantial improvements in wind tolerance would substantially improve productivity in windy locations.

All existing construction crawler cranes carry their counterweights. That arrangement increases ground bearing pressure, which adversely affects the machine's stability and ultimately its safety. Eliminating this problem is a primary goal of the present invention.

SUMMARY OF THE INVENTION

An object of the invention is to provide a derrick capable of lifting very heavy loads, in which the counterweight is not carried by the derrick structure, but instead is stationary, either above ground or below grade.

These and other objects are attained by a ring derrick as described below.

The derrick includes a boom and a back mast, both of which have an A-frame construction which stiffens the structure and in particular provides improved performance in strong winds.

An advantage of the invention is that the derrick does not have to support any of the counterweight, so its carriage can be designed solely to support the boom and ultimately any load lifted by the derrick.

Another advantage is that a buried counterweight does not obstruct movement of the derrick or other vehicles, which can drive over the counterweight.

A further advantage is that, despite its great lifting capacity, the derrick is constructed of modules which can be legally and safely transported over highways.

By reducing the construction schedule, improving safety, and eliminating the need for very large and mid-sized crawler cranes, the present invention provides a cost-effective tool for large construction projects.

Other objects and advantage of the invention will be apparent from the attached drawings and the following description.

DESCRIPTION OF THE PREFERRED EMBODIMENT

An A-frame ring derrick embodying the invention includes a slew carriage 10 (FIGS. 1-6) which rides on a circular track railway or "slewing ring" 12 centered around a geographically fixed vertical axis of revolution "C". The derrick's counter-weight 14, which is situated on the axis of revolution, is supported not by the slew carriage but rather entirely by the ground. The counterweight remains stationary while the slew carriage moves in an arc around it.

The counterweight 14 is preferably buried in the ground, with its top approximately flush with the grade of the site. This provides several advantages: other vehicles can drive over it; mobile offices and other items can be stored on it when the derrick is not in use; and after the derrick is removed, the counterweight can be left in place. Preferably the counterweight is cast of concrete in situ, around reinforcing structure (not shown). As an example, approximately 2700 cubic yards of concrete form a counterweight of sufficient mass to counterbalance a lifting moment of 110,000 tonne-meters.

Figure 1:
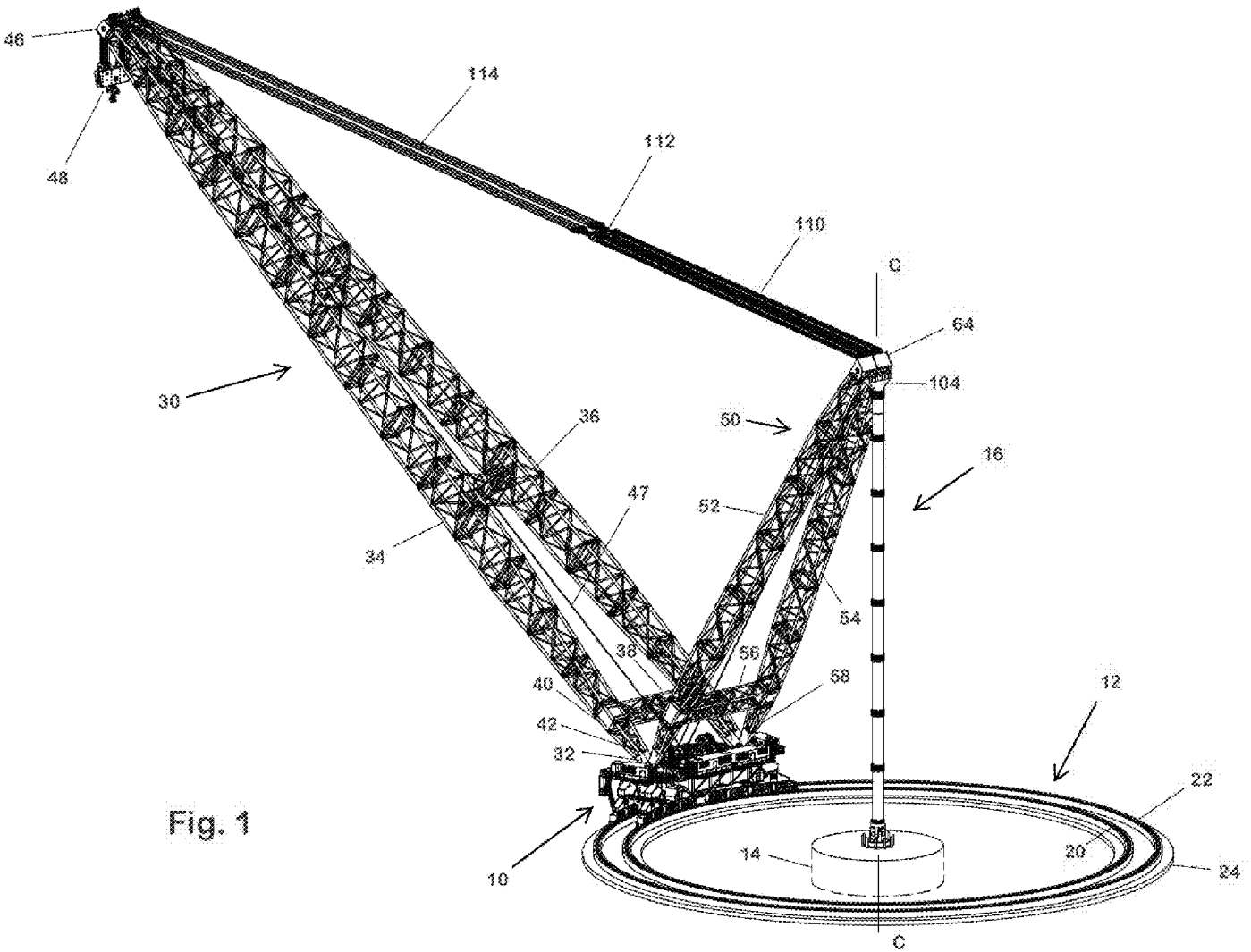
FIG. 1 is a perspective view of a ring derrick embodying the invention.

As shown in FIG. 1, a tension column 16 extends vertically upward from the counterweight. The tension column is described in detail below.

The circular track 12 or slewing ring preferably is formed by a pair of concentric rails 20, 22 which have broad, horizontal, flat (uncrowned) heads, as shown in the detail of FIG.

Figure 7:
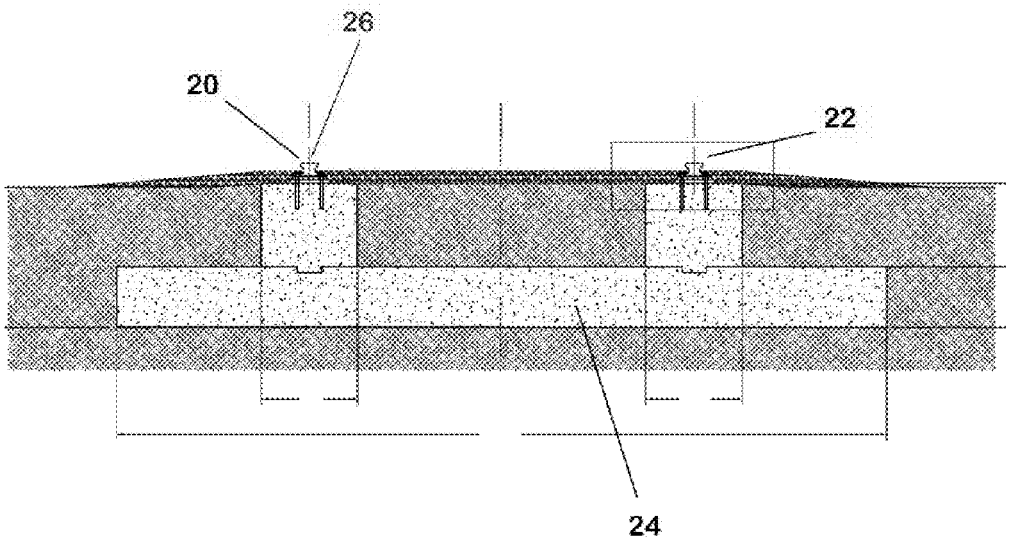
FIG. 7 is a sectional view of the cast-in-place slew ring for the derrick, taken on a vertical plane.

7. The rails are supported by a concrete or steel pad 24 at or below grade level; preferably the rails are embedded in the pad or backfilled with crushed stone or the like so that the rail heads 26 (FIG. 7) are nearly flush with the grade whereby cars and trucks can cross the track.

Figure 2:
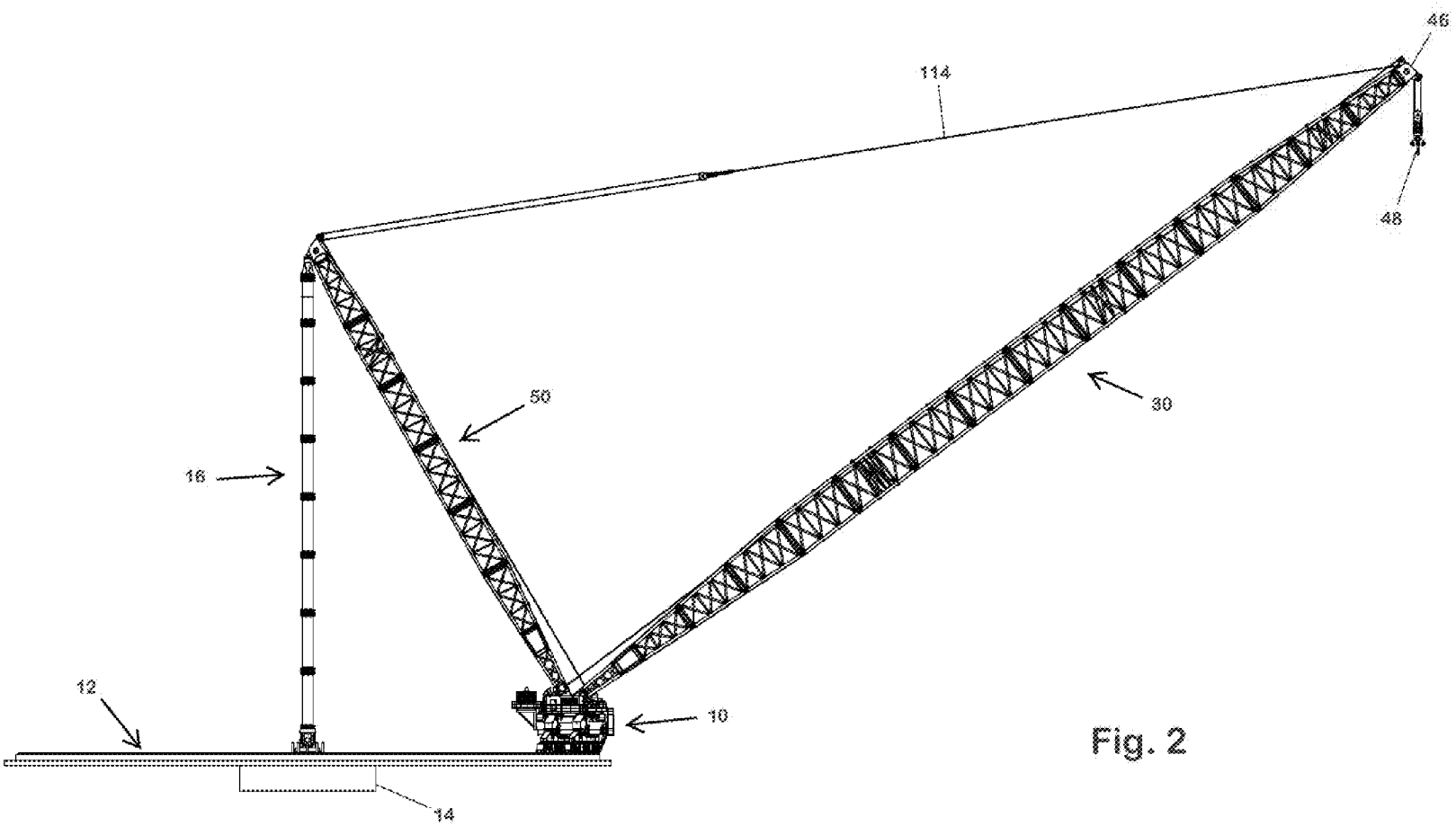
FIG. 2 side elevation thereof.
Figure 11:
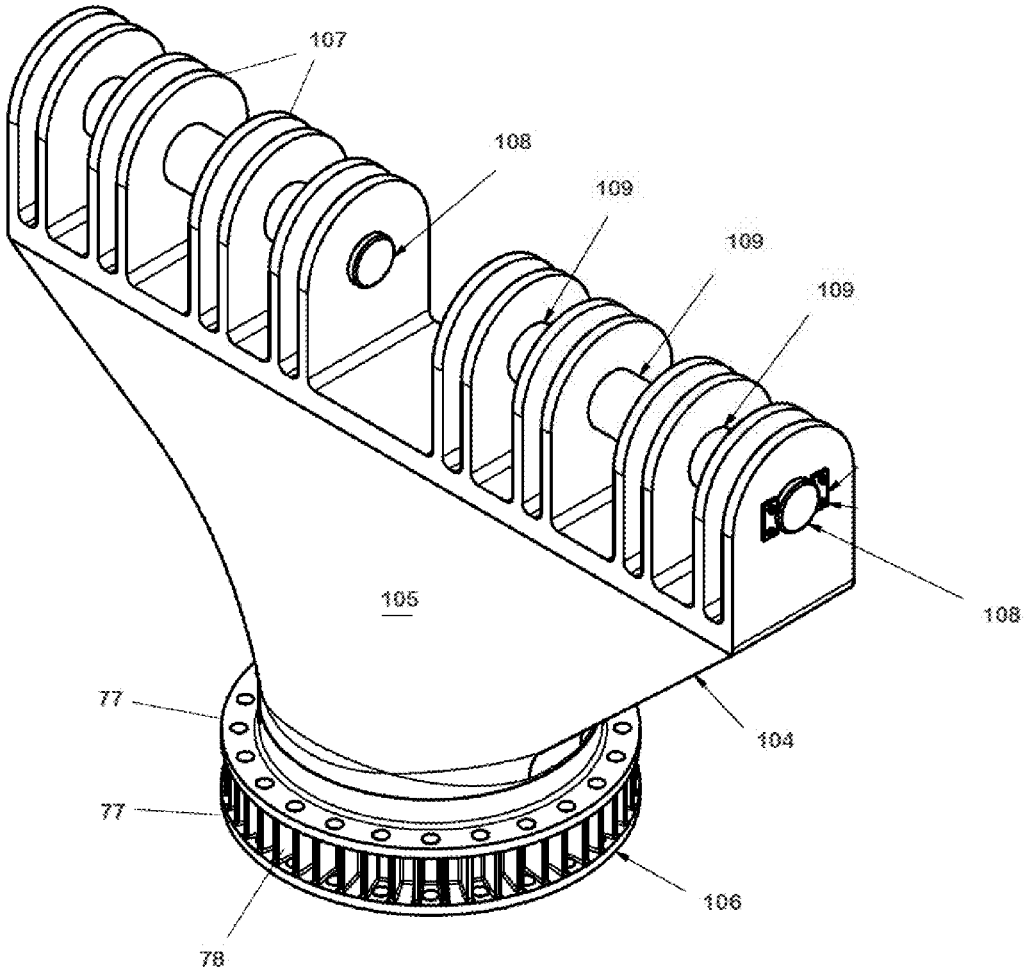
FIG. 11 is a perspective view of the head of the tension column.

FIG. 2 shows the carriage 10 on the track 12 which encircles the tension column 16. A main boom 30 extends from the carriage to the right and a smaller boom, called a "mast" 50 extends to the left, from the carriage to the top of the column 16. The mast head 64 and the tension tie column head 104 (FIG. 1) are interconnected by a pin and eye system (see FIGS. 8, 11) capable of handling the compression and tension loads imposed by the derrick.

Figure 3:
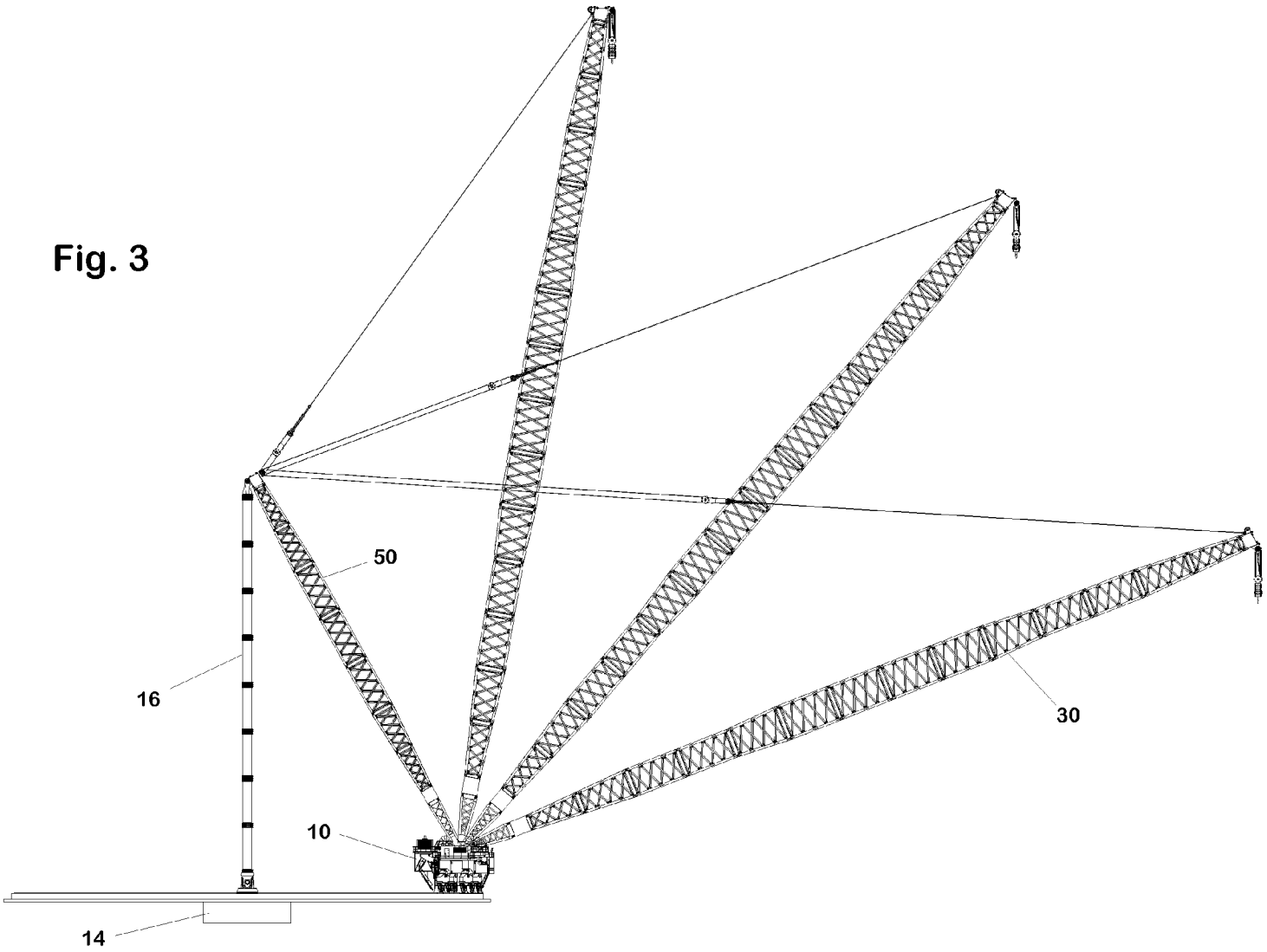
FIG. 3 is side view of the derrick, with its main boom shown in alternative positions.
Figure 4:
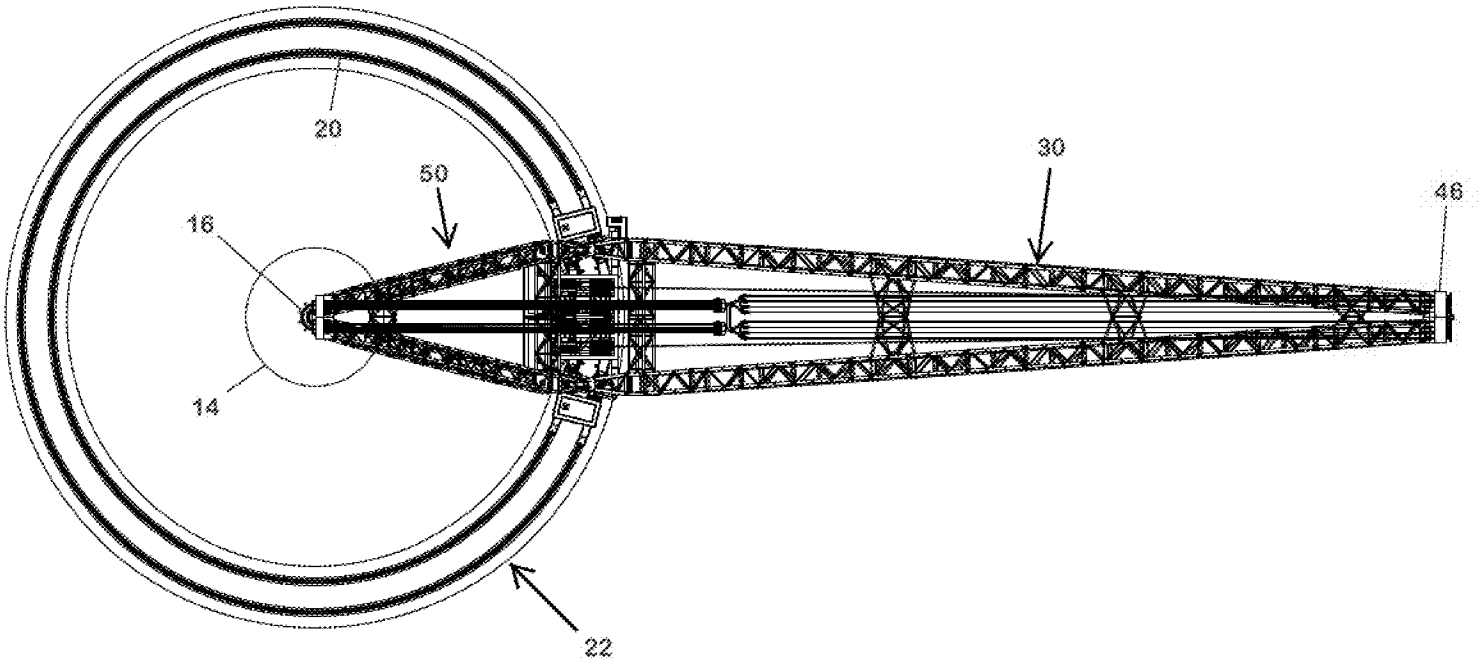
FIG. 4 is a top plan view of the derrick.

FIG. 3 shows the derrick with its main boom at various elevations. Normally the column is in tension to counterbalance the load being lifted. However, at high boom elevations with low load, or when the boom 30 (described below) is removed or resting on the ground, the column may be loaded in compression. High winds may also contribute to the creation of a compression force. Therefore, the tension column cannot be a flaccid or flexible member, and must be constructed to withstand substantial compression force without buckling, as well as high tension.

Figure 8:
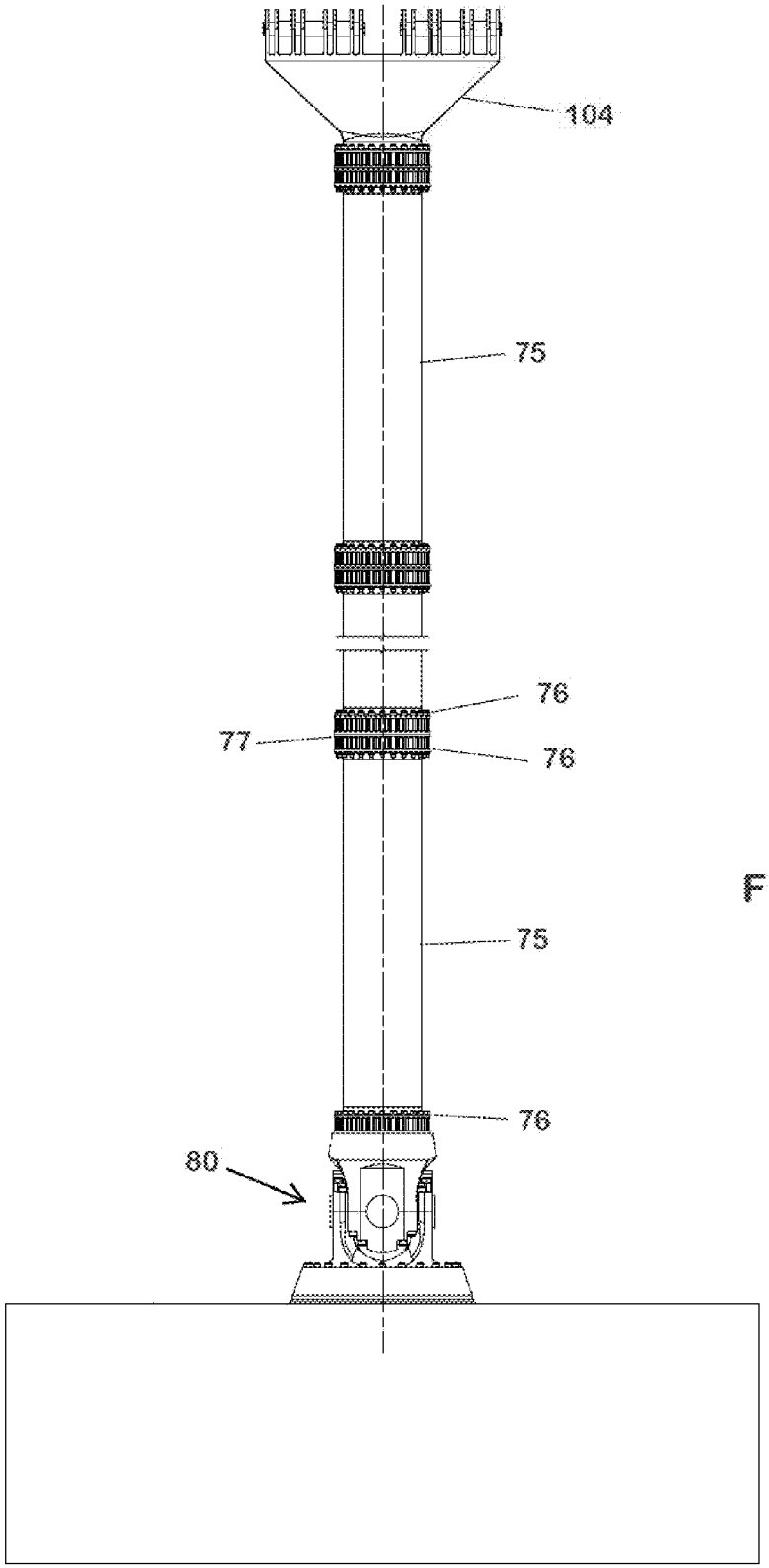
FIG. 8 is a front elevation of a tension column and the counterweight.

Preferably, the tension column 16 is assembled from a series of column segments 75, as shown in FIG. 8 (where several segments are omitted). Each segment is made of steel pipe, and has end flanges 76. Each end flange comprises two rings 77 with gussets 78 (FIG. 11) between the rings; both rings have a circumferential array of holes to receive bolts whereby the segments can be joined in series.

Figure 9:
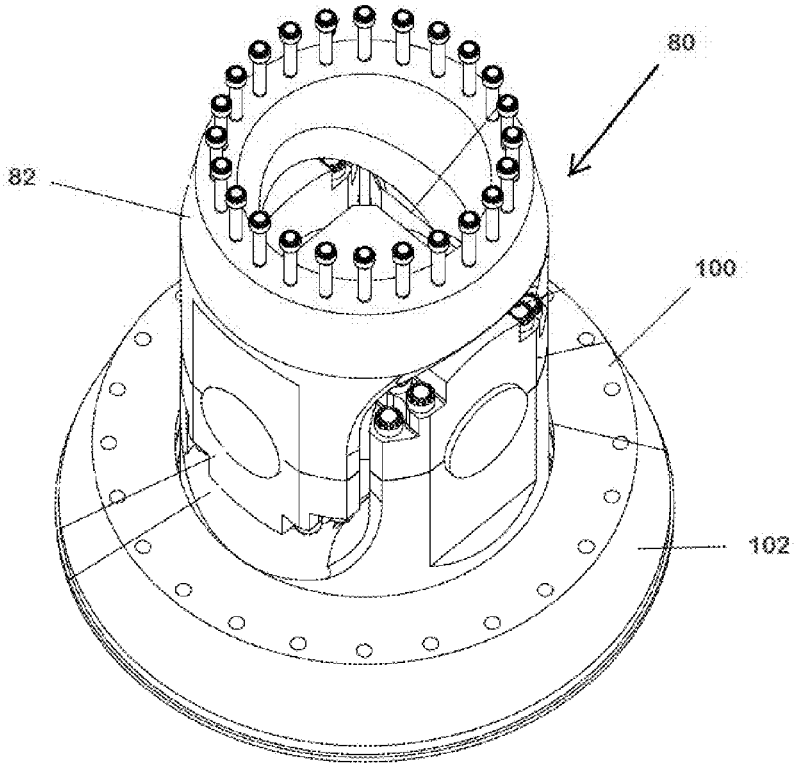
FIG. 9 is a perspective view of the swivel joint at the bottom of the tension column.
Figure 10:
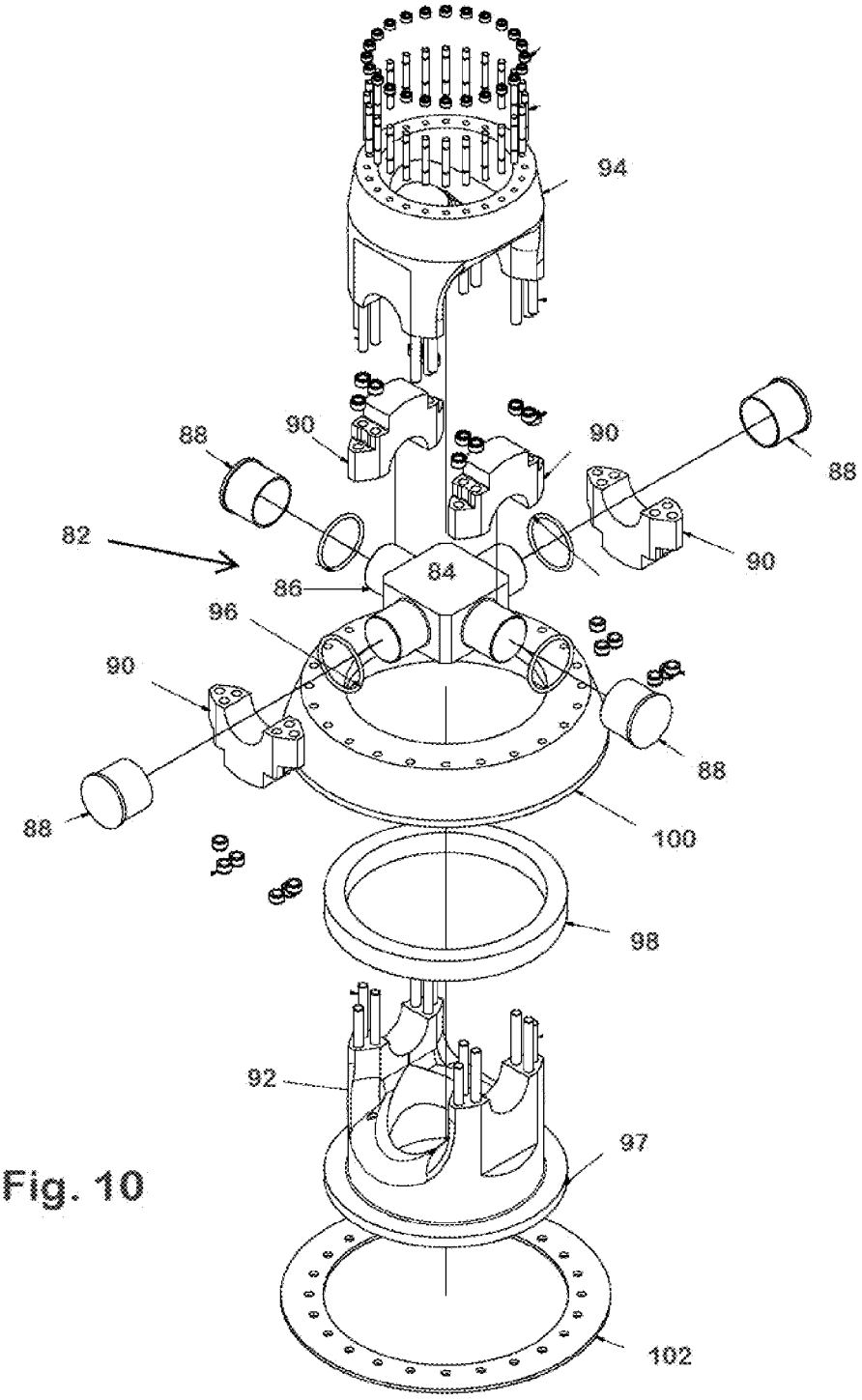
FIG. 10 is an exploded perspective view of the swivel joint.

Because the tension column 16 is rigid and torsionally stiff and the counterweight is stationary, a universal swivel base 80 is placed between it and the counterweight 14 to minimize or eliminate torques and bending moments on the column. As shown in the details of FIGS. 9 and 10, the universal swivel base contains a Hookes-type universal joint 82 that permits the tension column to deviate slightly from vertical without bending. The universal joint has a cross journal 84 having four trunnions 86, which are received in—and are supported by—plain trunnion bearings 88. These bearings are retained by respective bearing caps 90, two of which face bearing seats on a bottom yoke 92 and two of which face bearing seats on a top yoke 94. The items 96 are O-rings. The top yoke 94 is bolted to the bottommost column segment 75, while the bottom yoke 92 is free to turn about a vertical axis, which is coincident with the derrick's axis of revolution "C". A flange 97 on the bottom yoke bears upward against a triple roller thrust bearing 98, which is sandwiched between that flange and a bearing retainer ring 100. The retainer ring is bolted through the sole plate 102 to the counterweight's reinforcing rod structure (not shown).

A column head 104 (FIG. 11) is bolted to the top of the uppermost column segment. The head comprises a body portion 105 with a bolting flange 106 at its bottom and an arrangement of parallel plates 107 at its top. The plates have aligned holes forming eyes through which a pair of shafts 108 are passed to interconnect the column head 104 and the mast head 64 (see FIG. 1). Bushings 109 maintain the spacing between the plates.

The derrick's boom 30 can be raised or lowered to various inclination angles, away from the counterweight. The boom (see FIG. 1) is an A-frame structure, comprising two non-prismatic lattice mast sections 34, 36. Non-prismatic lattice masts are well known, and their design is a matter of ordinary skill in this field. The boom sections 34, 36 are braced near their bottom ends by a tension tie frame 38 which interconnects transition frames 40. Each transition frame connects one of the boom sections 34, 36 to a respective boom foot 42.

The top ends of the boom sections meet at a boom head 46, which contains sheave packs that carry the hoisting cables 47 over the end of the boom to the load block 48.

The back mast 50 also has an A-frame design, and is composed of two lattice mast sections 52, 54 separated by a tie frame 56 near their bottom ends. Mast feet 58 extends downward from the tie frame, to a hinge connection described below. The upper ends of the masts meet at a mast head 64, which supports a sheave pack assembly that carries the boom hoist cables over the end of the back mast. The mast head has a series of eyes, like those shown in FIG. 11, which interleave with the eyes on the mast head 104. The shafts 108 are inserted through the interleaved eyes to secure the top of the mast 50 to the top of the column 16. The hinge mounting of the back mast—even though the mast is not raised and lowered in operation—allows for minor variations in mast inclination, yawing of the carriage as it moves on the track, and dynamic deformation of the carriage.

The boom feet 42 and the feet 58 of the mast are hinged to each other and to the slew carriage. The hinges 32 are formed by a pair of massive hinge pins 60, which support the boom and the mast on the carriage and connect the boom and mast to one another.

Figure 13:
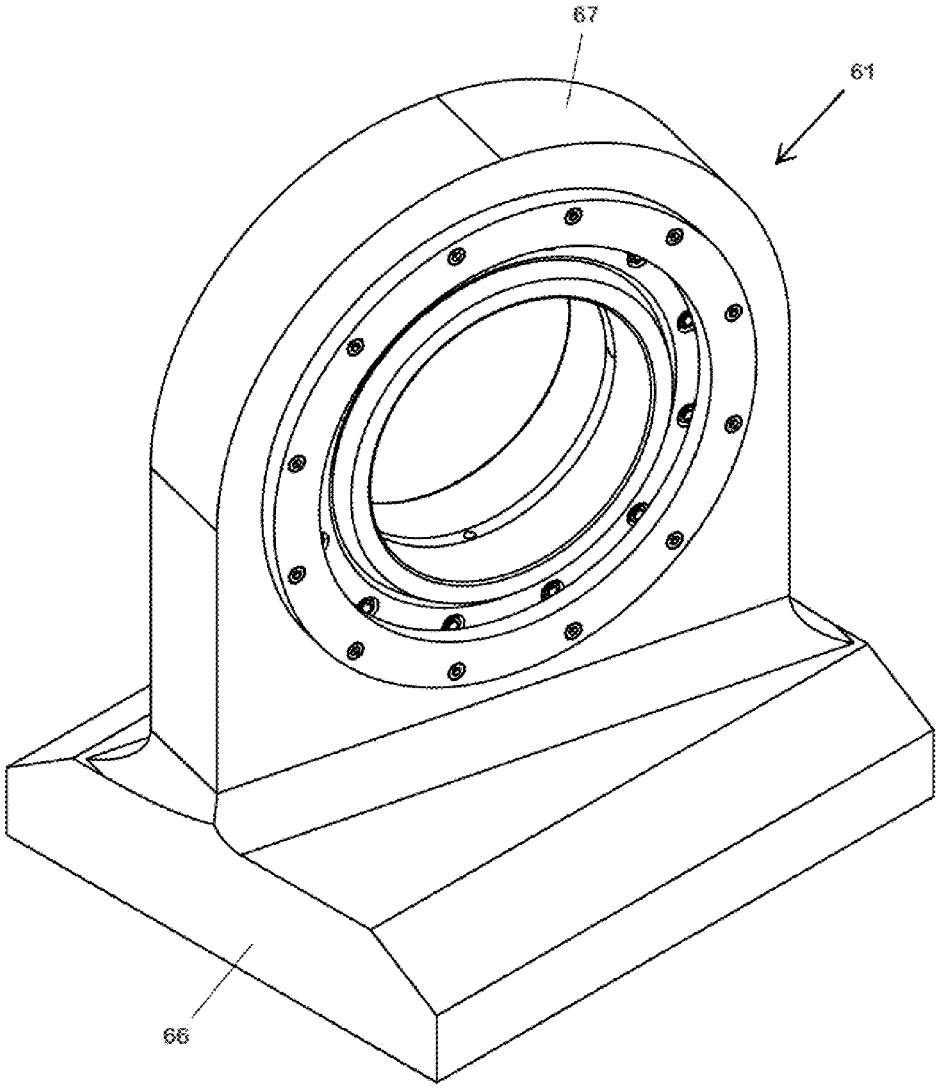
FIG. 13 is a detail of the bearing shown in FIG. 12.
Figure 15:
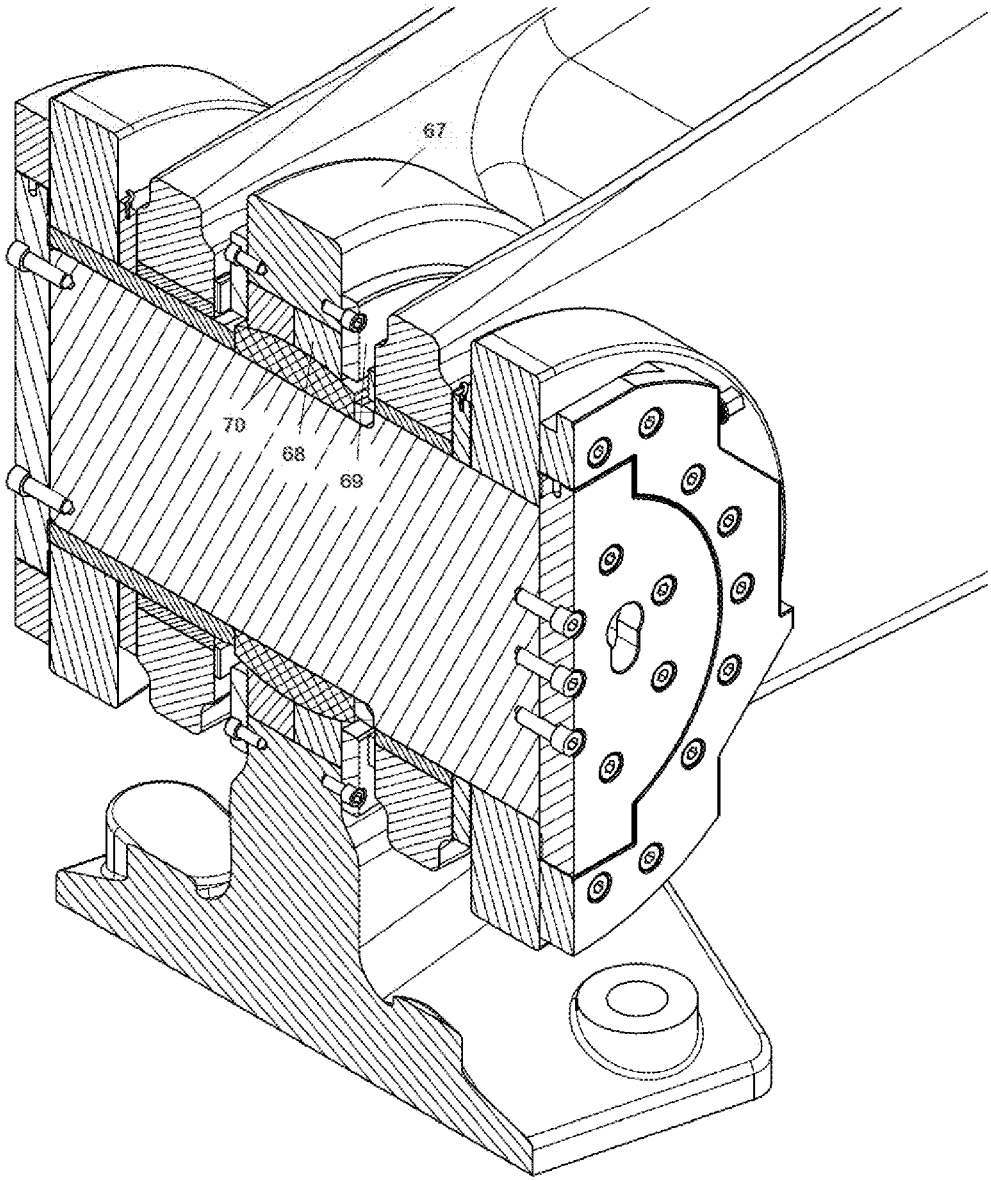
FIG. 15 is a sectional view, taken on a vertical diametral plane of the hinge pin, of the structure shown in FIG. 12.

Each hinge pin 60 passes through a spherical plain bearing 61 mounted on the carriage. The bearing is best seen in FIGS. 13 and 15. Each bearing is mounted on the carriage above and on the center plane of one of the articulating girders 150', described below. The combined weight of the boom, the mast, the lifted load and the reaction force from the tension column is distributed directly and evenly to the carriage's trucks so that the bearing force on the tracks is spread over the entire length of the carriage.

Figure 14:
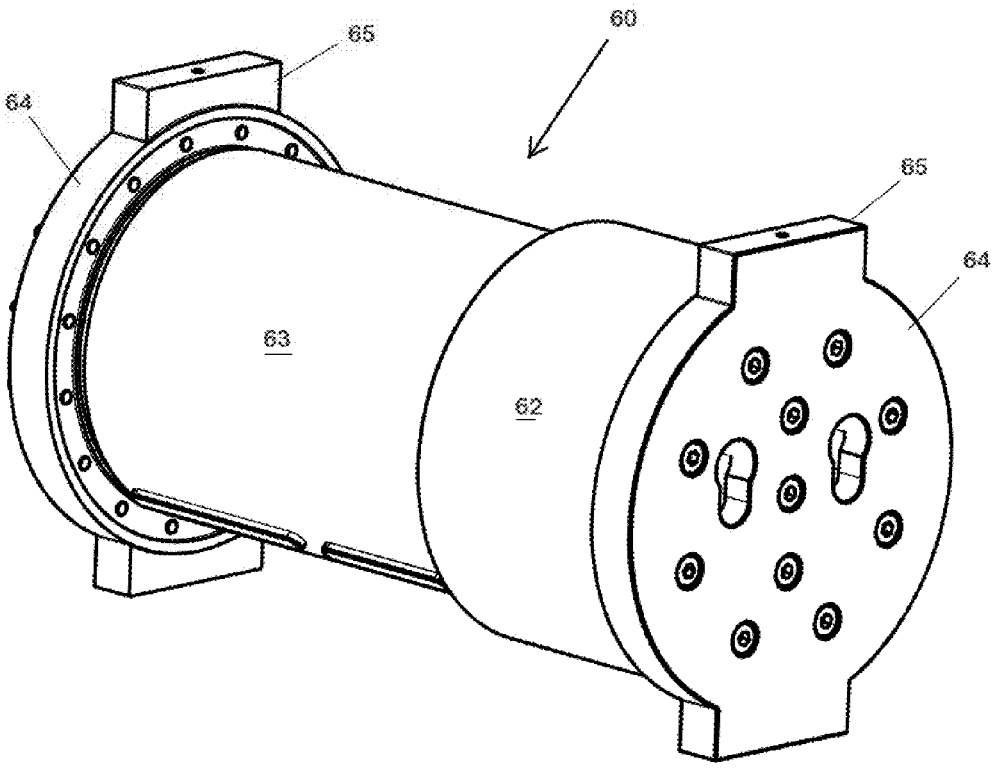
FIG. 14 is a detail of the hinge pin shown in FIG. 12.

The hinge pin 60 (FIG. 14) is stepped, having a big end 62 and a small end 63. The pin passes through the spherical bearing and both the boom foot and the mast foot, which straddle the bearing. Retainer plates 64 are bolted to the ends of the hinge pin to keep it in position. Each outer retainer plate has a pair of ears 65 which sit in recesses in a retaining collar 71 that is bolted to the boom foot 42.

The bearing 61 (FIG. 13) comprises a body having a foot 66 which is connected to the carriage, and a hoop portion 67 which contains a split spherical race 68 (FIG. 15). The halves of the race are kept within the hoop by race retainers 69 that are bolted to either side of the hoop. The inside surface of the spherical race bears against a barrel-shaped bushing 70 sized to receive the small end of the hinge pin.

Figure 12:
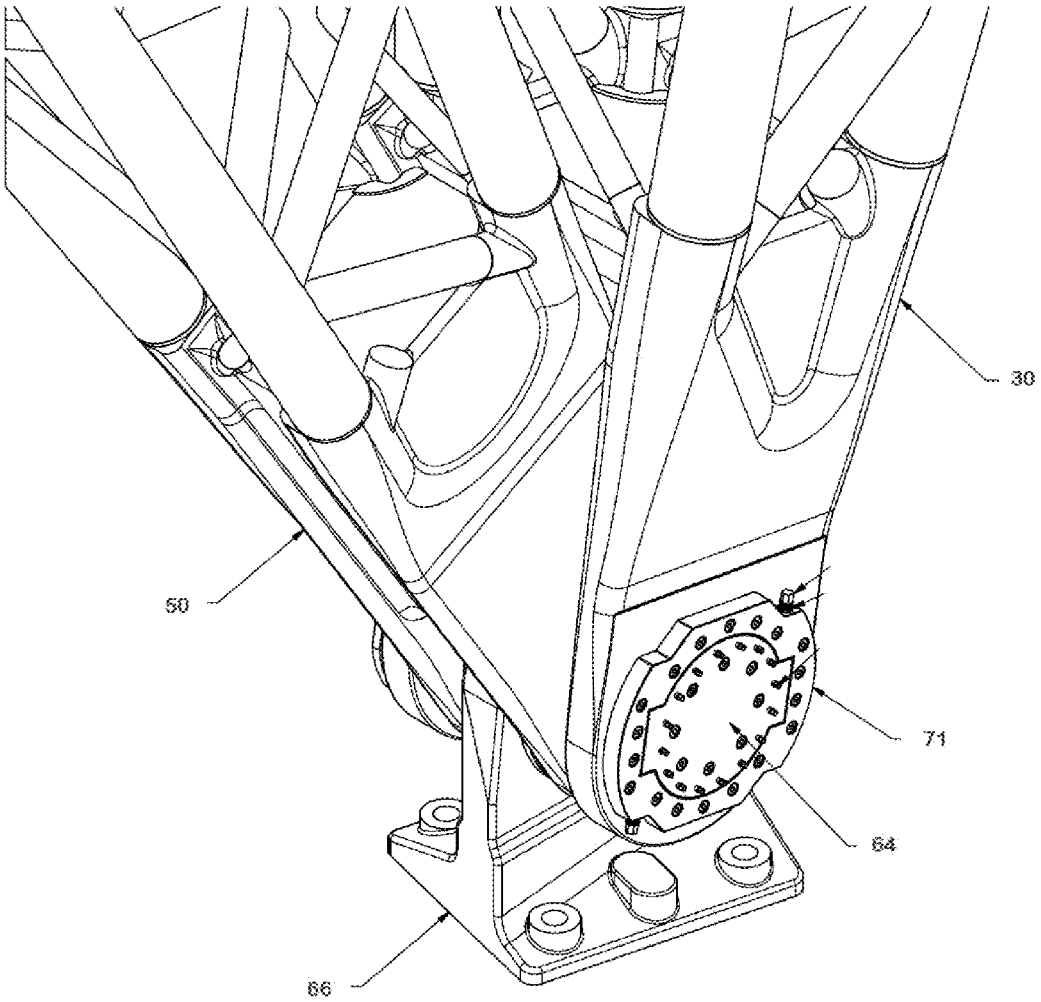
FIG. 12 is a close-up perspective view of a foot of the boom, a foot of the mast and their shared supporting structure.
Figure 16:
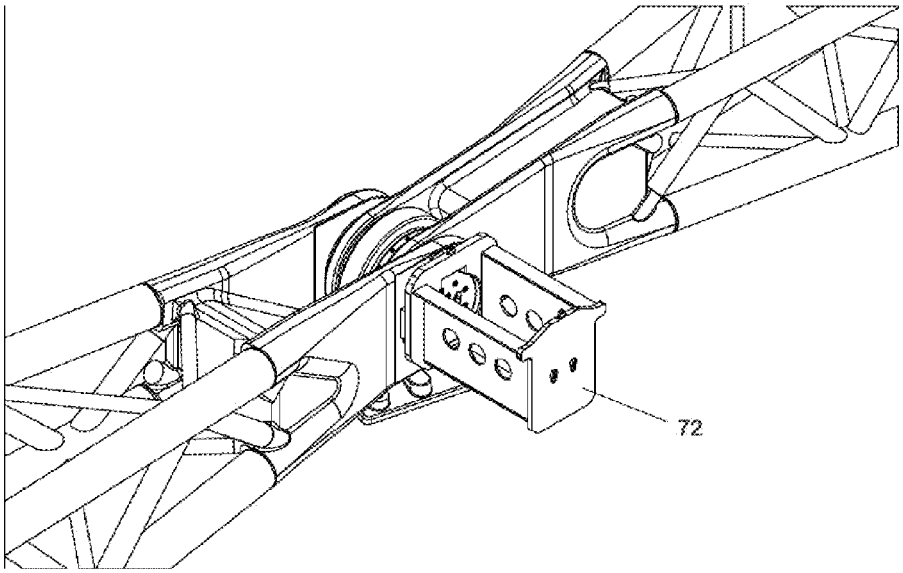
FIG. 16 is a view of the structure of FIG. 13, with the boom and mast laid out horizontal, and with the addition of a pin cradle.

FIG. 12 shows a retaining collar 71 disposed around the pin retainer plate. The collar may have reliefs formed on its periphery, as shown in FIG. 15, so that it can serve as a mount for a pin cradle 72, shown in FIG. 16. The cradle supports the pin when the joint is being assembled or disassembled.

Figure 5:
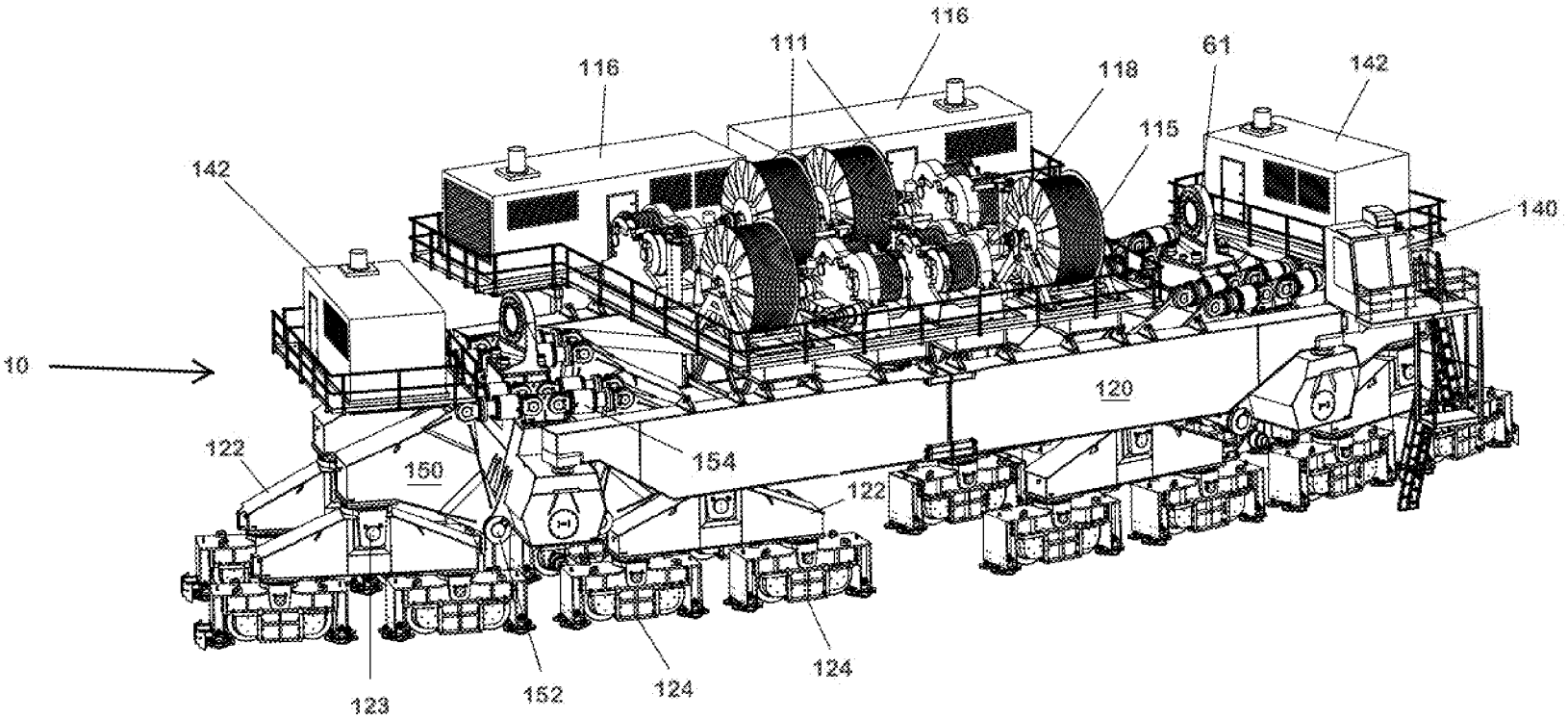
FIG. 5 is a perspective view of the derrick's carriage, from the front and one side.
Figure 6:
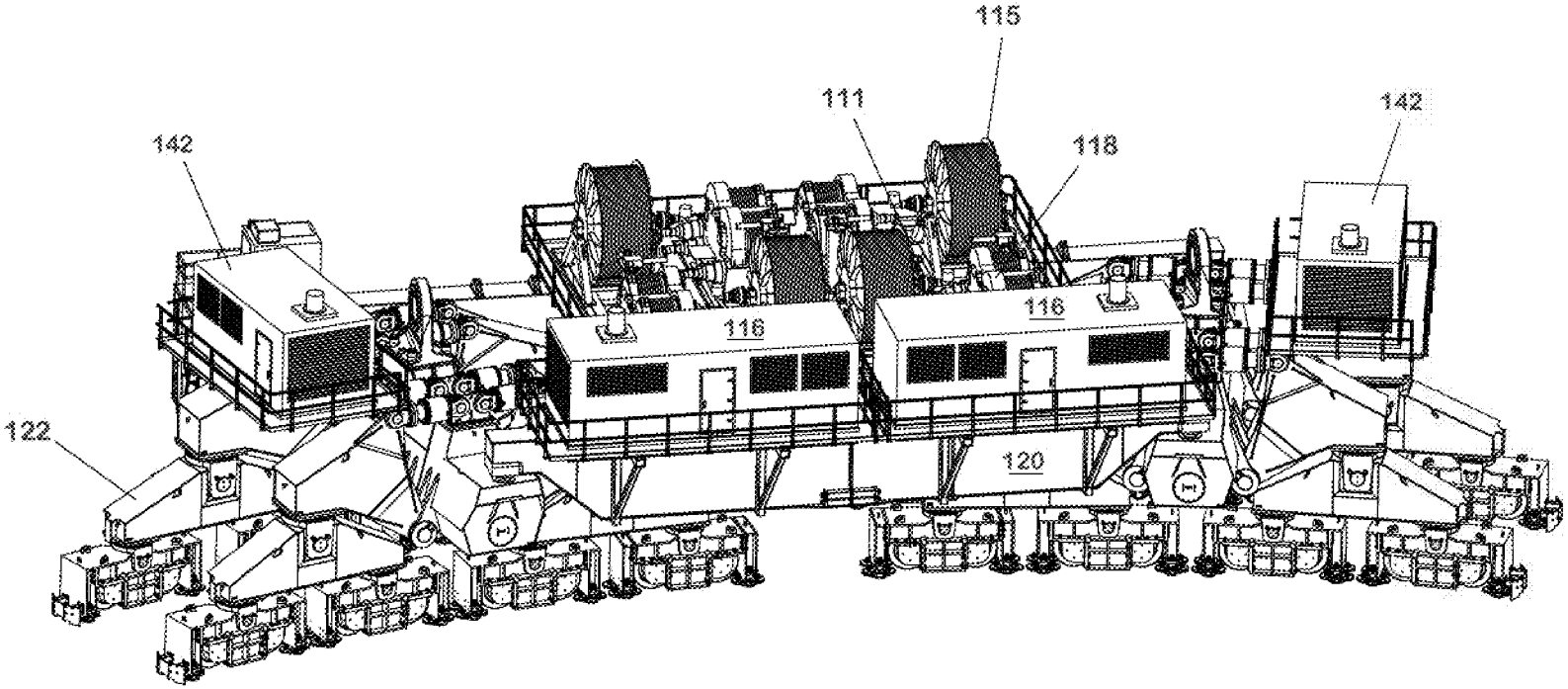
FIG. 6 is a perspective view thereof, from the rear, with the booms removed.

As seen in FIGS. 5 and 6, the slew carriage has a chassis or frame 120 which is connected to eight swing arms 150, four at either end of the frame. The swing arms are connected to the frame by pins 152 which permit the swing arms to pivot on a horizontal axis. Horizontally extending hydraulic cylinders (linear motors) 154, best seen in FIG. 5, dynamically and independently control the position of the respective swing arms. Extension of one of the cylinders pushes its respective swing arm down, as necessary to keep the carriage level, when a track irregularity such as a depression is encountered.

Figure 17:
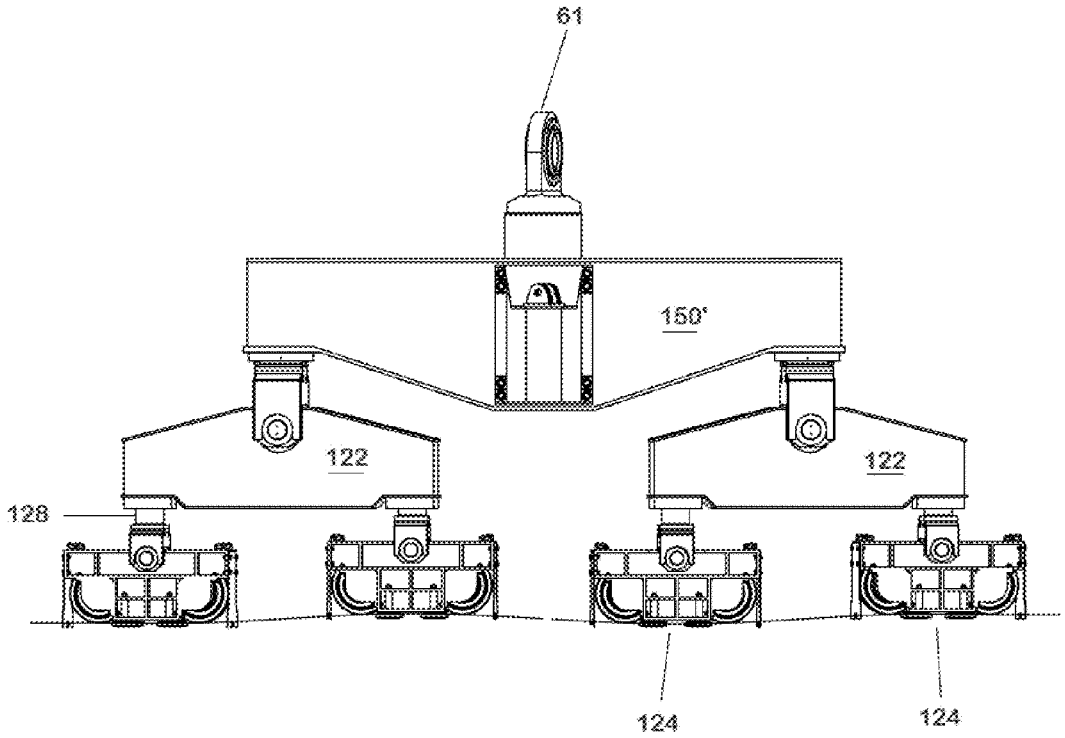
FIG. 17 is a view of a portion of the carriage showing an alternative leveling suspension arrangement.

The swing arms have the primary purpose of leveling the slew carriage to compensate for settlement of the slew ring. It is critical that the slew carriage be kept level to avoid side loading the boom and mast. The presently preferred leveling arrangement is shown in FIGS. 5 and 6; an alternative is shown in FIG. 17. described below. Many modifications to, and variations of the disclosed arrangements are possible.

Figure 18:
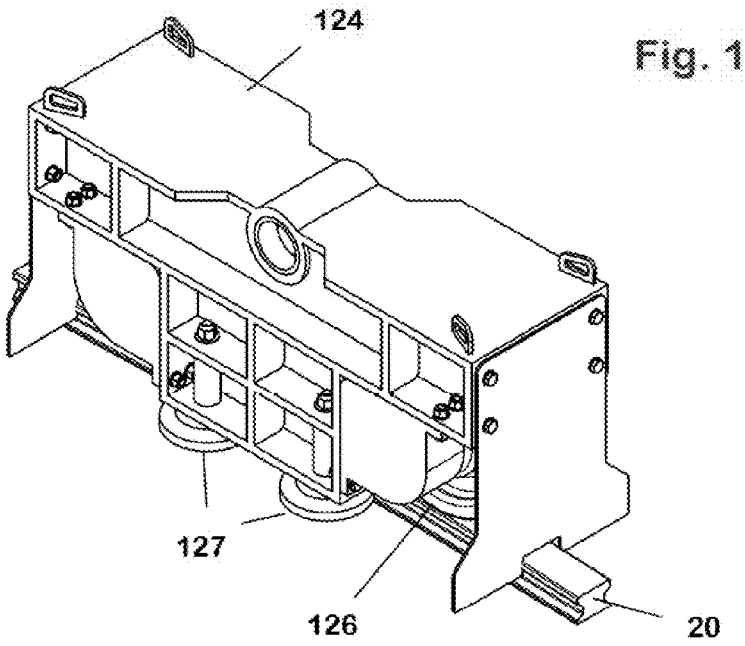
FIG. 18 is a perspective view of one truck of the carriage, from above.
Figure 19:
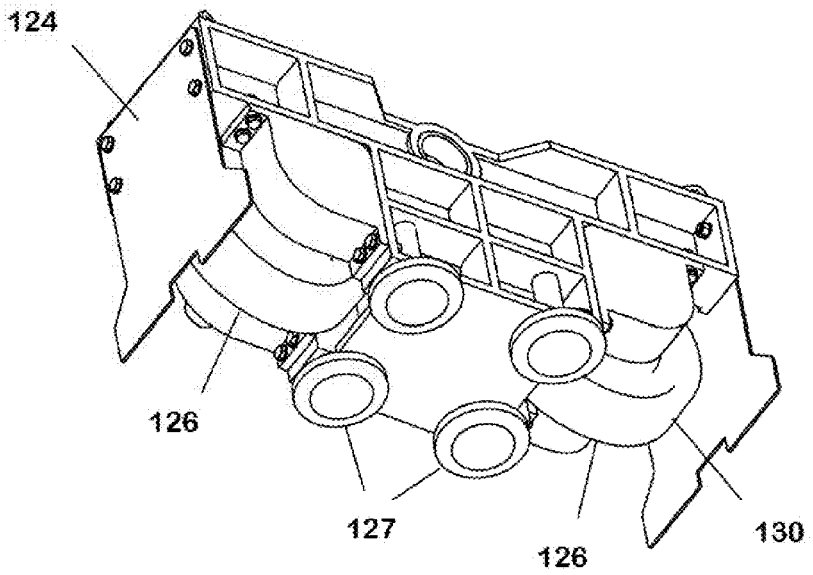
FIG. 19 is a perspective view of the truck, from below.

Each end of each swing arm is supported by an equalizer saddle 122 (see FIGS. 5, 6 and 17), each of which has a bearing or gudgeon connection to the articulating girder. Each equalizer saddle is, in turn, connected by gudgeons 123 to a pair of trucks 124, one of which is shown in FIGS. 18 and 19. All connections below the articulating girder have swivel bearings to allow for out-of-parallel conditions between the interior and exterior rails. The truck has two wheels 126 which ride on one of the rails 20, 22. Four pairs of equalizer beams and eight pairs of trucks—thus thirty-two wheels in all—are illustrated in the drawings, but many other arrangements are possible. One can determine the best arrangement by conducting an analysis of cost versus allowable ground bearing capacity in a particular situation.

Some or all of the trucks have driving wheels which may be activated to move the carriage on the track. We presently prefer that the innermost trucks be driving trucks, and that the outermost trucks be idlers. Power is applied to driving truck's wheels by hydraulic or electric motors, not shown. Hydraulic power is generated at units 142 (FIG. 5) mounted on the carriage deck; fluid flow to the truck motors is regulated by an operator in the cab 140.

An alternative arranged for compensative for track irregularities is shown in FIG. 17. Here, an articulating girder 150' has replaced each pair of swing arms, and instead of the horizontal cylinders 154 shown in FIG. 5, a hydraulic jack 128 is disposed between each wheel truck and its equalizer beam. The jacks are raised or lowered dynamically by an automatic leveling system (not shown) to keep the carriage steady despite height variations in the rails. The jacks 128 are shown extended different distances in FIG. 17, compensating for track variations. The jacks draw power from the same units that drive the wheels.

Each of the wheels 126 has a peripheral bearing surface 130 (FIG. 19) that runs on one of the concentric rails 20, 22. The wheels have no flanges: they are kept on the tracks by opposed rollers 127 that rotate on vertical axes and are supported by the truck. The wheel's peripheral surface is not cylindrical, but rather is frustoconical (the apex of the cone being a spot on the axis of revolution at the base of the swivel). The wheels' axles are all aligned toward that spot. This geometry avoids scuffing which would otherwise occur between the wheels and the rails, especially considering their width of about 20 cm. Consequently, the wheel axles are not parallel to one another: they converge on the axis of revolution mentioned previously. Other details of the trucks are matters of ordinary design skill, and therefore they are not elaborated on.

The wheels of this preferred embodiment of the invention ride on the concentric circular rails 20, 22. Alternatively, however, the invention could be practiced by replacing the wheels and rails with crawler tracks, which are well known in the art, or some other arrangement which constrains the slewing carriage to movement about the axis of revolution.

As shown in FIGS. 5 and 6, the frame 120 of the slewing carriage supports a prime mover 142 such as a diesel engine and hydraulic pump set, or a diesel-generator set. The primer mover provides power (in mechanical, hydraulic or electrical form) to at least some of the trucks when it is desired to move the derrick along the rails. The prime mover also supplies power to the cable drums which reel in cable to raise the boom, or to lift a load at the end of the boom. The drums are independently controllable by the derrick operator. Design details of the prime mover, the motors for operating the drums and the wheels, the operator controls, the hydraulic/electrical circuitry and the leveling system are matters of ordinary design choice and therefore are not described in detail. The leveling is essential for a derrick which moves around a static counterweight.

The inclination angle of the main boom is controlled by boom cables 110 (FIG. 1) which are reeled onto the innermost reels or drums 111 (see FIGS. 5 and 6) on the slew carriage. The cables are reeved on a sheave assembly or bridle 112 (FIG. 1) which is connected to the tip of the main boom by a pair of steel pendants 114.

The load line hoisting cables 47 are wound onto the outermost reels 115 in FIG. 6. Both sets of reels are driven by power units 116 mounted on the carriage deck. Preferably, sufficient wire rope friction at the torque drum 118 is developed by using a double capstan traction hoist, however, a standard single drum hoist is also capable of fulfilling the requirement.

It should be understood that the foregoing is a description of the presently preferred form of the invention, and that many modifications are possible. For example, a monorail version could be implemented, booms other than A-frame types could be used, and details of the running gear could be altered, without departing from the inventive concepts.

Since the invention is subject to modifications and variations, it is intended that the foregoing description and the accompanying drawings shall be interpreted as only illustrative of the invention defined by the following claims.

We claim:

1. A hoisting device comprising a mobile slewing carriage constrained to move around a geographically fixed axis of revolution, a geographically stationary counterweight lying on said axis of revolution, a tension column, capable of withstanding substantial axial compression, connected to the counterweight and extending upward from said counterweight along said axis of revolution, a swivel joint connecting the counterweight to the tension column, which permits the tension column to deviate slightly from vertical, a back mast extending from said slewing carriage to the tension column, the back mast being connected to the slewing carriage at one end and to the tension column at its other end, and a main boom pivotally connected to the slewing carriage and extending from the slewing carriage in a direction away from said tension column, wherein both the main boom and the back mast are joined to the slewing carriage by hinges, each said hinge comprising a hinge pin supporting both the back mast and the main boom, and a spherical bearing affixed to the slewing carriage and supporting the hinge pin.

2. The invention of claim 1, wherein substantially all of the counterweight is below ground level.

3. The invention of claim 1, wherein the tension column swivel joint comprises a universal joint and a low friction thrust bearing supporting the universal joint.

4. The invention of claim 3, wherein the universal joint comprises a cross journal having trunnions which are supported on bearings between an upper yoke connected to the tension column and a bottom yoke connected to the counterweight.

5. The invention of claim 1, further comprising a stationary substantially circular track supporting the slewing carriage.

6. The invention of claim 5, wherein the track comprises at least one rail running in a horizontal plane about said axis of revolution, and the slewing carriage has at least two wheels which run on the rail.

7. The invention of claim 6, wherein the slewing carriage includes a dynamic leveling system for keeping the slewing carriage level despite deviations of the rail from the horizontal plane.

8. The invention of claim 5, wherein the track comprises a pair of concentric rails, each running in a substantially horizontal plane at a constant radius around said axis of revolution.

9. The invention of claim 5, wherein the slewing carriage has a plurality of trucks, each having plural wheels which run on the track, and a suspension which distributes loads from the boom and mast to the wheels.

10. The invention of claim 9, wherein the suspension comprises at least one stabilizer bar, each bar being supported by at least two of said trucks, and having a pivot connection to the carriage.

11. The invention of claim 10, wherein the suspension further comprises at least one articulating girder, each articulating girder being supported by at least two of said stabilizer bars, and having a pivot connection to the carriage.

12. The invention of claim 11, further comprising hydraulic means for controlling the pivoting of the articulating girder.

* * * * *